United States Patent [19]

Clark et al.

[11] 4,323,318

[45] Apr. 6, 1982

[54] SLIDE COMPRESSION MECHANISM FOR FLEXIBLE POST BINDER

[75] Inventors: John P. Clark; Jack H. Michaelis, both of Elmhurst; Frank J. Malcik, Berwyn; all of Ill.

[73] Assignee: Wilson Jones Company, Chicago, Ill.

[21] Appl. No.: 804,446

[22] Filed: Jun. 7, 1977

Related U.S. Application Data

[63] Continuation of Ser. No. 551,986, Feb. 21, 1975, abandoned, which is a continuation-in-part of Ser. No. 315,789, Dec. 18, 1972, abandoned.

[51] Int. Cl.[3] ..... B42F 13/06

[52] U.S. Cl. ..... 402/17

[58] Field of Search ..... 402/17

[56] References Cited

U.S. PATENT DOCUMENTS

| | | | |
|---|---|---|---|
| 1,933,762 | 11/1933 | Ross | 402/17 |
| 2,119,843 | 6/1938 | Brennan | 402/17 |
| 2,498,901 | 2/1950 | Segal | 402/17 |
| 3,572,867 | 3/1971 | Cooper | 402/17 |
| 3,628,877 | 12/1971 | Barnes | 402/17 |

FOREIGN PATENT DOCUMENTS

| | | | |
|---|---|---|---|
| 2089324 | 12/1971 | France | 402/17 |
| 137925 | 1/1920 | United Kingdom | 402/17 |

*Primary Examiner*—Stephen C. Pellegrino
*Attorney, Agent, or Firm*—Pennie & Edmonds

[57] ABSTRACT

A slide compression mechanism for a flexible post binder is disclosed which includes specially constructed means for limiting outward movement of each compressor member relative to the channel member on which it is slidably mounted. More particularly, this motion limiting means comprises at least one pair of specially constructed interengageable longitudinally aligned stops positioned internally of the channel member. The slide compression mechanism also possesses a hook portion having a raised lip on the hook end which not only facilitates automatic assembly of the slide compression mechanism onto the channel member but also serves as a means for limiting the inward movement of each compressor member relative to the channel member.

3 Claims, 8 Drawing Figures

SLIDE COMPRESSION MECHANISM FOR FLEXIBLE POST BINDER

CROSS REFERENCE TO RELATED APPLICATION

This is a continuation of application Ser. No. 551,986, filed Feb. 21, 1975, now abandoned, which is a continuation-in-part application of my co-pending application Ser. No. 315,789 filed on Dec. 18, 1972 now abandoned.

BACKGROUND OF THE INVENTION

This invention relates generally to binders for holding a plurality of looseleaf sheets together in collated condition to form a bound booklet or the like and more particularly to binders of the type commonly known as flexible post binders.

In construction, flexible post binders comprise at least one compression slide mechanism which generally includes an elongated channel member and a pair of compressor members slidably mounted on the channel member. In its bottom located near each end, the channel member has at least one hole for receiving one end of a flexible resilient post which also passes through aligned holes in the collated looseleaf sheets. These ends of the posts are bent over to lie within the channel and are held in this bent-over condition by the compressor members operatively positioned along the channel to overlie the bent-over post ends. Each compressor member is moved between its respective operative and inoperative position simply by sliding it along the channel member. The other end of each post suitably engages the opposite side of the collated sheets. For instance, the other end of each post may be equipped with an enlarged head having a diameter larger than the diameter of the post receiving holes in the collated sheets. With such an arrangement, the looseleaf sheets are held tightly together between the head on one side and the channel member on the other side by the interconnecting post. In place of a headed post, another slide compression mechanism may be utilized. In the latter instance, the head is not necessary inasmuch as both ends of each post are held in bentover condition by their respective compressor members with the looseleaf sheets bound tightly together between the two channel members by the interconnecting posts.

In addition to providing a simple and convenient means of binding looseleaf sheets together, flexible post binders of the type described may also be utilized to store the bound looseleaf sheets in suspension-type filing cabinets or racks. For this purpose, each compressor member is formed with a hook portion at its outer end. With the compressor members in their operative position overlying the respective bent-over post ends, this hook portion extends outwardly beyond the end of the channel member; and, in this position, the bound looseleaf sheets may be hung or on suspended spaced on parallel support rods with which the filing cabinet or rack is equipped.

Both regular (non-suspension type) and suspension-type flexible post binders (i.e. ones having compressor members equipped wih hook portions) are equipped wih a means for limiting the outward movement of the compressor member. With suspension-type binders movement of the compressor members is limited so that only the hook portion is permitted to extend beyond the end of the channel leaving the remaining or compression portion of the compressor member engaging the channel to perform its intended function of holding the posts in bent-over condition which is necessary to maintain the looseleaf sheets in bound condition. With regular or non-suspension type binders, outward movement of the compressor members must be limited so that the compressor members do not fall out of the channel during use. Also, with any flexible post binder, the outer limit of movement is generally made to coincide with the optimum operative position of the compressor member (i.e. the position where satisfactory compressive force is exerted on the bent-over post ends for all post positions). Thus the user is provided with a readily ascertainable operating position; it being only necessary to slide the compressor members outward as far as possible.

One type of motion limiting means is disclosed in copending and commonly assigned U.S. patent application Ser. No. 84,703, filed Oct. 28, 1970. There, the ends of the side rails of the channel member are turned inward toward each other to provide a restriction of the channel. The compressor members which are mounted internally of the channel are constructed such that the hook portions thereof may pass freely between the inturned ends of the channel while the compression portions thereof are prevented from passing therebetween.

Another type of motion limiting means is disclosed in U.S. Pat. No. 3,628,877. There, the compressor member, which is slidably mounted on the channel externally thereof, engages stops or lugs which project externally from the channel to limit its outward movement. These stops or lugs are located externally at the juncture between the side rails and the channel bottom.

Still another type of motion limiting means is disclosed in French Pat. No. 2,089,324. In this patent, tiny pimples or lugs are formed in the top surface of the channel rails. The compressor member, as in U.S. Pat. No. 3,628,877, is externally mounted on the channel and is provided with mating dimples or recesses on its undersurface which engage the lugs on the channel rails thereby limiting outward movement of the compressor member relative to the channel.

The present invention provides a novel and unobvious motion limiting means for flexible post binders which is simpler in construction, easier to produce and more dependable in operation than the motion limiting devices utilized in heretofore known flexible post binders.

SUMMARY OF THE INVENTION

In accordance with the present invention outward movement of each compressor member relative to the channel member is limited by means of at least one pair of interengageable stops which are longitudinally aligned relative to the channel. The stops are both positioned internally of the channel between the side rails thereof. One stop is carried by the compressor member and depends downwardly into the channel from the underside of the slide. The other stop is carried by the channel and depends upwardly from its bottom. Each stop projects into the confines of the channel a distance greater than the distance which the other stop projects into the channel so that the stops engage each other as the compressor member is moved outwardly. The compressor stop and the channel stop are appropriately positioned so that only the hook portion of each compressor is capable of extending beyond the end of the channel.

In the presently preferred construction, the stop carried by the channel member is inclined at an angle with respect to the bottom surface of the channel and the stop carried by the compressor member comprises a shoulder which defines the termination point of a complementary angled beveled surface formed in an elongated raised rib carried by the compressor member and extending longitudinally relative to the channel along substantially the entire length thereof. As the compressor member is moved outwardly of the channel, the beveled surface glides over the inclined channel stop until the shoulder and the channel stop are brought into engagement thus preventing further outward movement of the compressor member.

DETAILED DESCRIPTION OF THE INVENTION

Figure 1:
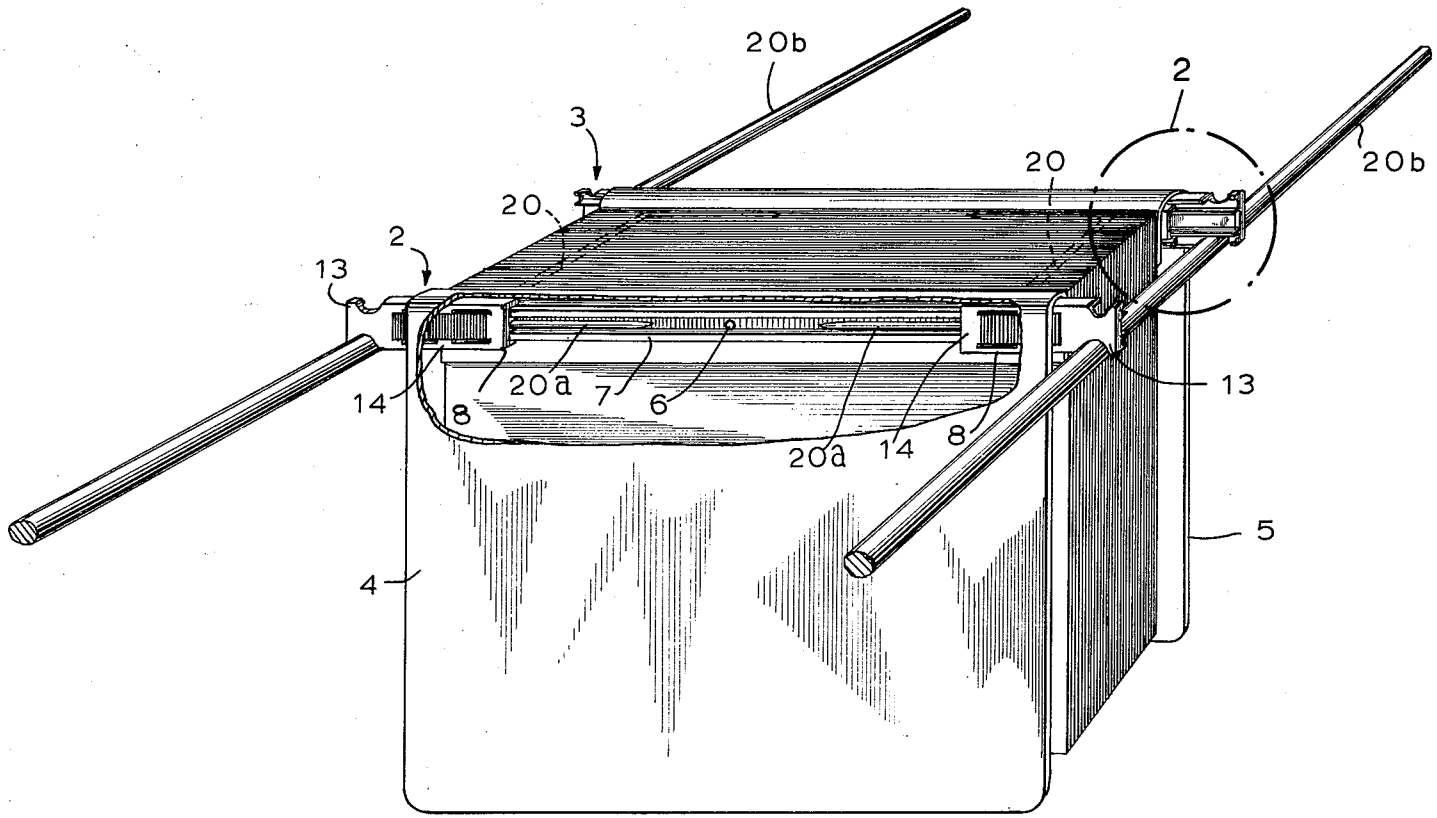
FIG. 1 is a perspective view of a suspension-type flexible post binder utilizing a slide compression mechanism according to this invention with sheets bound thereby.
Figure 2:
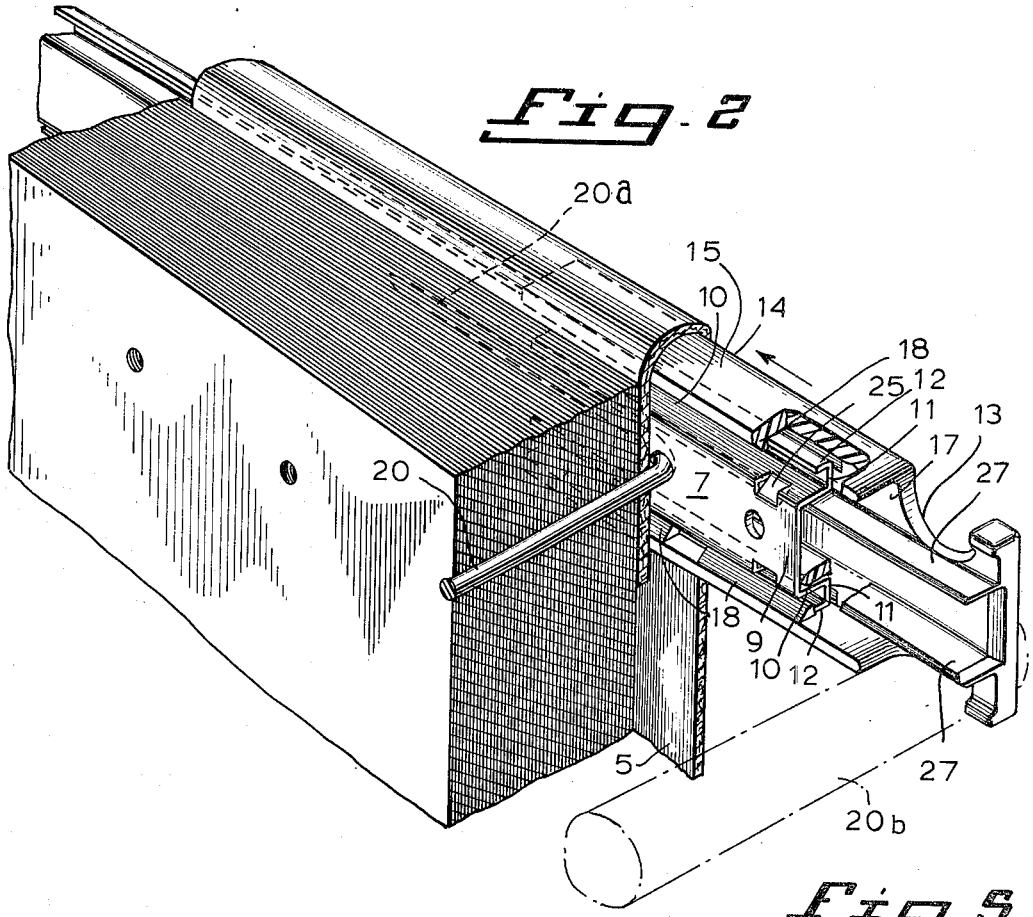
FIG. 2 is a perspective view of circled area 2 in FIG. 1.
Figure 3:
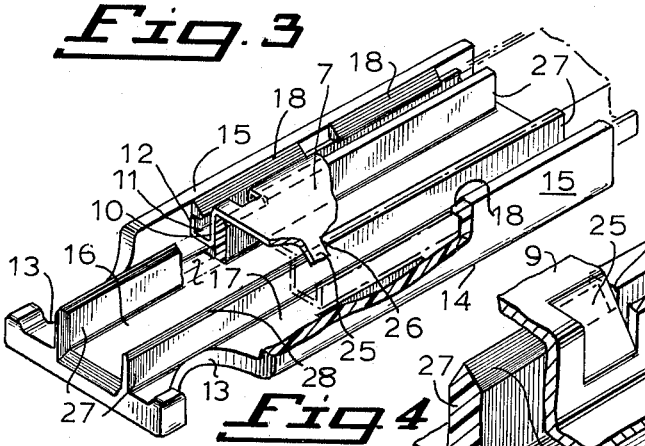
FIG. 3 is a perspective view from a different angle of the end portion of the slide compression mechanism shown in FIG. 2.

With reference initially to FIG. 1, there is shown a plurality of looseleaf pages or sheets 1 bound together into a booklet by means of a suspension-type flexible post binder which includes identical front and back slide compression mechanisms 2 and 3, respectively, each constructed according to the teachings of the present invention. The front and back slide compression mechanisms 2 and 3 are attached to the marginal edges of front and back covers 4 and 5, respectively, by suitable means such as by rivets 6. To provide the booklet with a clean-lined and neat appearance, each slide compression mechanism is, in the assembly shown, attached to the inner surface of the respective cover; each cover being folded back over its marginal edge to hide the slide compression mechanism from view. In FIG. 1 the front cover 4 has been broken away to show the front slide compression mechanism 2. As shown, the slide compression mechanism 2 includes an elongated channel member 7 and a pair of compressor members 8 slidably mounted on the channel member. Each compressor member 8 is divided into a hook portion 13 and a compression portion 14. The covers and looseleaf sheets are held together in booklet form by a pair of flexible posts 20 each of which extends through aligned holes in the looseleaf sheets, covers, and channel members as shown. The ends 20*a* of the posts 20 are bent-over to extend inwardly of the channel members; each post end being held in bent-over condition within the channel by the overlying compression portion 14 of the respective compressor member. The hook portion 13 of each compressor member extends outwardly beyond the end of the channel member to thereby support the booklet in hanging relationship on parallel file cabinet rods 20*b* as shown. As best shown in FIGS. 2 and 3, the channel member has a bottom 9 and side rails 10 each of which carries a flange 11 having a bent-over end 12 extending generally parallel to its respective side rail. The compression portion 14 of each compressor member has sides 15 connected together by a web 16 to define a guideway 17 receiving the channel member 7 with the external surfaces of bent-over ends 12 of the flanges 11 disposed closely adjacent to the internal surfaces of sides 15 as shown. Each side 15 of the compression portion 14 carries a pair of spaced apart inwardly protruding ear elements 18 which underlie the bent-over ends 12 of flanges 11 to retain the compressor member in slidable engagement with the channel member. The web 16 is formed with a plurality gripping treads 19 on its exterior surface to facilitate moving of the compressor member along the channel by finger pressure.

Figure 4:
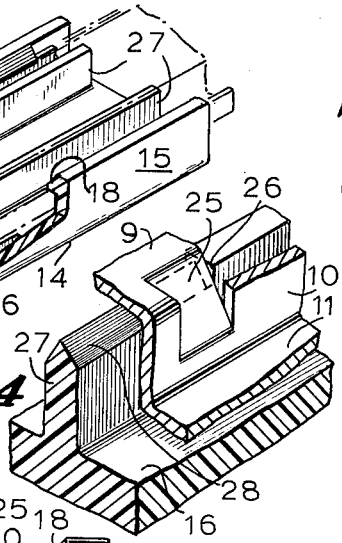
FIG. 4 is an enlarged perspective view of the motion limiting means of the slide compression mechanism shown in FIG. 3.
Figure 6:
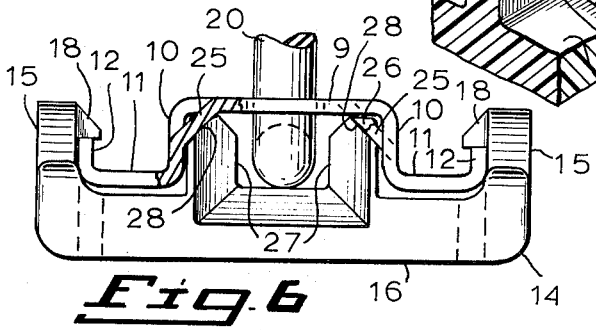
FIG. 6 is an end view of the slide compression mechanism shown in any of the other figures.
Figure 5:
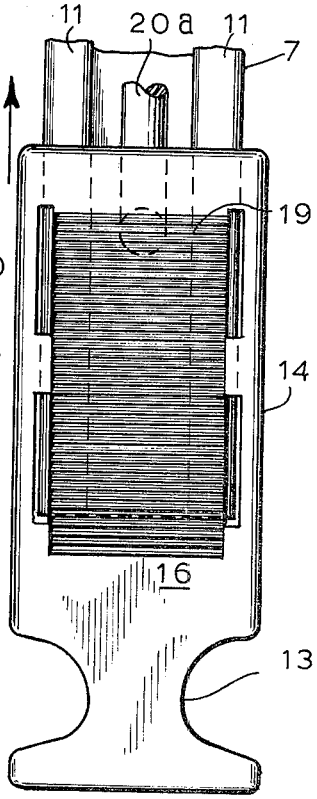
FIG. 5 is an enlarged top plan view of one end portion of the front slide compression mechanism shown in FIG. 1.

To limit outward movement of the compressor member so that only its hook portion extends beyond the end of the channel member, interacting stop means are provided on the compressor member and channel member. In the construction shown the stop means on the channel member comprises a pair of oppositely positioned relatively flat bridging protuberances 25 each of which, as best shown in FIG. 4 is inclined laterally outward from the bottom 9 of the channel member to intersect the side rail 10 of the channel member. Each protuberance 25 thereby spans the corner defined by the juncture of the bottom 9 and side rails 10. As presently preferred, bridging protuberances 25 are formed easily and economically by simply deforming a small section of material at the channel corners by conventional shear forming techniques so that it extends inwardly into the channel.

The coacting stop means carried by the compressor member are defined by shoulders 26 formed at a predetermined point along a pair of elongated ribs 27 which depend downwardly from the undersurface of the web 16 of the compressor member and which extend along the entire length of the compressor member through both its compression and hook portions. As shown the ribs 27 are spaced laterally apart to lie closely adjacent the side rails 10 of the channel member; the space between the ribs 27 defining an elongated receptacle for receiving the bent-over ends 20*a* of the flexible posts 20. The height of each rib is approximately equal to the distance separating the undersurface of the web 16 of the compressor member and the upper surface of bottom 9 of the channel member. Each shoulder defines the termination point of a beveled surface 28 in each rib 27; the beginning point of the beveled surface 28, as shown, being situated at the outer end of the hook portion of the compressor member. The beveled surface 28 is sloped at an angle (relative to the channel bottom 9) which corresponds to the angle of inclination of the bridging protuberances 25.

With the construction described, outward movement of each compressor member is limited so that only the hook portion of each compressor member extends beyond the end of the channel; the compression portion of each compressor member being retained inwardly of the channel ends to perform its intended function of holding the bent-over ends 20*a* of flexible posts 20 in place. Further outward movement of each compressor member is impeded when the shoulders 26 on the ribs 27 contact the bridging protuberances 25. Until this contact occurs it will be recognized that the beveled surfaces 28 glide effortlessly and smoothly over the flat surfaces of protuberances 25 facing the beveled surfaces.

Figure 7:
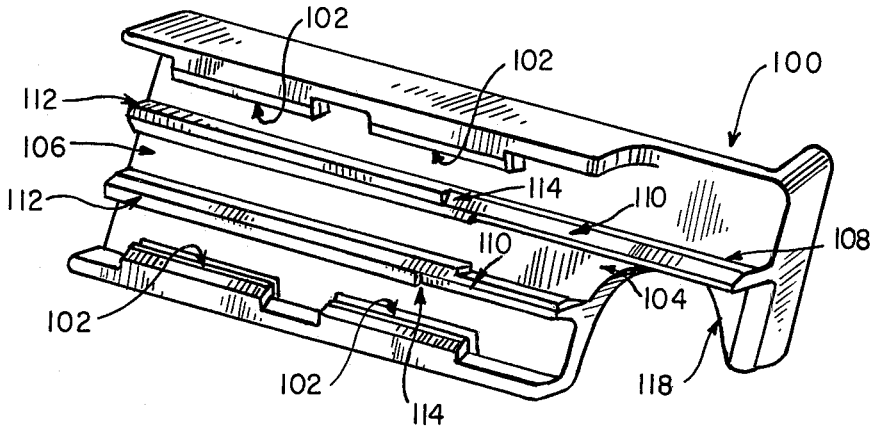
FIG. 7 is a perspective view of the channel member engaging side of an alternative compression member.
Figure 8:
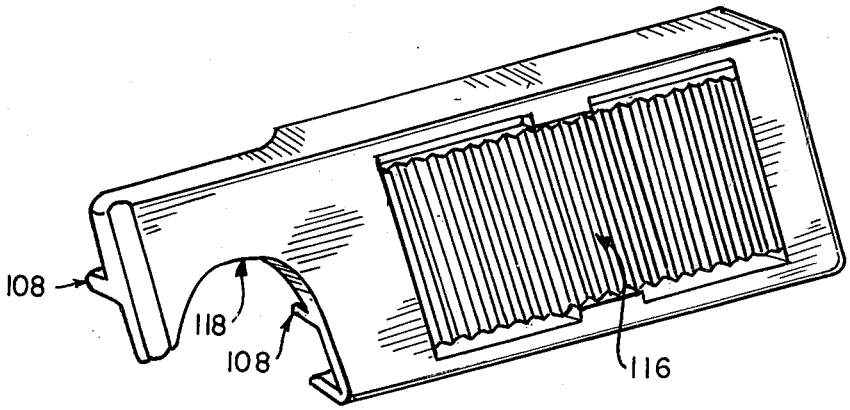
FIG. 8 is a perspective view showing the opposite side of the member illustrated in FIG. 7.

An alternative embodiment of a compression member constructed in accordance with the present invention is illustrated in FIGS. 7 and 8. This particular embodiment of the inventive compression member is particularly rugged in construction. The compression member 100 includes four inwardly protruding ear elements 102. Ear elements 102 are adapted to underlie the bent over ends of the flanges of a channel member. They thus act to contain the compression member 100 in slidable engagement with the channel member. Compression member 100 also includes enlarged guideway 104 through which a flexible resilient post is guided into a relatively smaller portion 106 of the guideway within which the flexible resilient post is held. Two ribs 108 serve the function of accurately positioning the compression member in proper relationship to the channel member by serving as stops. Ribs 108 include beveled portions 110 and unbeveled portions 112. The surfaces 114 of unbeveled portions 112 engage the bridging protuberances which span the corners defined by the juncture of the bottom and side rails of the channel member, thereby stopping and accurately positioning the member.

The compression member 100 may be most easily slid to the proper position by means of a serrated surface 116 particularly adapted for gripping the user's finger. After it is slid into position, hook portion 118 may then be used to support the binder within an appropriate file as is illustrated in FIG. 1.

With a slide compression mechanism constructed according to the teachings of the present invention an extremely dependable and smooth acting motion limiting means for the compressor members is provided. Moreover, the ribs which carry the shoulder stops of the compressor members advantageously provide good stability to the compressor members during movement along the channel members and the ribs advantageously enhance frictional and compressive engagement between the compressor members and the bent-over ends of the flexible posts thus insuring a positive retention of the posts and thus a tight secure binding of the looseleaf sheets. In addition to the above, a slide compression mechanism according to this invention is relatively simple in structure and quite economical to produce.

We claim:

1. In a flexible post binder for binding a plurality of looseleaf sheets or the like together, said binder comprising at least one elongated channel having two side rails interconnected by a bottom, each channel having at least one pair of post receiving holes therein each adapted to receive a flexible post extending through aligned holes in the looseleaf sheets, the ends of said posts being adapted to be bent-over within the channel to hold the looseleaf sheets in bound condition, a pair of compressor members each slidably mounted for longitudinal movement on the channel into compressive overlying relationship with one of the bent-over post ends to hold said post end in bent-over condition, each of said compressor members including a major body portion having generally parallel upper and lower sides and extending in a plane between said rails and in overlying relationship to said rails, each compressor also having a pair of substantially parallel reinforcing ribs extending from the underside of its major body portion and into said channel, said ribs being spaced apart sufficiently to guidingly receive a flexible post therebetween, the distance between said rails being a plurality of times greater than the transverse dimension of either of said ribs, and motion limiting means for preventing outward movement of each compressor member beyond a predetermined point on the channel, said motion limiting means comprising:

(a) at least one pair of cooperatively engaging longitudinally aligned stops positioned within the channel with one stop of each pair being a portion of said channel projecting into the path of the other stop; and (b) said other stop of each pair comprising a shoulder on one of said reinforcing ribs, said one rib having two portions along its length, a first portion of said rib from one end thereof to said shoulder being of such shape and dimension to pass by said one stop, a second portion of said rib beginning at said shoulder being of such shape and dimension as to prevent its passage past said one stop, whereby upon outward movement of each compressor member along the channel the two stops of each pair engage each other to prevent further outward movement of the compressor member beyond said predetermined point;

each compressor member also including a hook portion at one end thereof for supporting the binder on spaced-apart bars, and at least a part of at least one of said ribs extending from the underside of said hook portion to reinforce said hook portion.

2. The improvement according to claim 1 wherein:

(a) said one stop comprises a relatively flat surface inclined with respect to the bottom of the channel; and (b) said first portion of said rib has a beveled surface, said beveled surface having an angle of slope approximately equal in degree and direction to the angle of inclination of said one stop.

3. The improvement according to claim 1 in which each compressor member includes:

(a) compressor channel engaging means including a flange portion formed along each side of the channel and ear elements on each compressor member which flange portions and ear elements, as positioned and proportioned, permit sliding engagement and prevent substantial movement between said channel and each compressor member in a direction perpendicular to the direction of sliding movement.

* * * * *